US009441322B2

(12) United States Patent
Kim et al.

(10) Patent No.: US 9,441,322 B2
(45) Date of Patent: Sep. 13, 2016

(54) DRYER WITH A WASTE HEAT RECOVERY MEANS

(71) Applicant: LG Electronics Inc., Seoul (KR)

(72) Inventors: Doohyun Kim, Seoul (KR); Geunhyung Lee, Seoul (KR); Sungjun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 14/310,532

(22) Filed: Jun. 20, 2014

(65) Prior Publication Data

US 2014/0373379 A1 Dec. 25, 2014

(30) Foreign Application Priority Data

Jun. 20, 2013 (KR) ..... 10-2013-0071177

(51) Int. Cl.
*D06F 58/26* (2006.01)
*D06F 58/20* (2006.01)
(Continued)

(52) U.S. Cl.
CPC ..... *D06F 58/26* (2013.01); *D06F 58/02* (2013.01); *D06F 58/206* (2013.01); *D06F 58/263* (2013.01); *F28D 15/0266* (2013.01)

(58) Field of Classification Search
CPC ..... F26B 19/00; F26B 21/00; F26B 21/06; D06F 59/00; D06F 58/20; D06F 58/23; D06F 58/26
USPC ..... 34/86, 595, 601, 610; 68/5 C, 5 R, 18 R, 68/12.06; 8/139, 149, 159
See application file for complete search history.

(56) References Cited

U.S. PATENT DOCUMENTS 4,112,590 A * 9/1978 Muller ..... D06F 58/24 34/596
4,603,489 A * 8/1986 Goldberg ..... D06F 58/02 34/605

(Continued)

FOREIGN PATENT DOCUMENTS

CA 2753072 A1 3/2013
CH 705546 A2 2/2013

(Continued)

OTHER PUBLICATIONS

European Search Report dated Nov. 5, 2014 from corresponding European Patent Application No. 14172999.6, 5 pages.

(Continued)

*Primary Examiner* — Stephen M Gravini
(74) *Attorney, Agent, or Firm* — Fish & Richardson P.C.

(57) ABSTRACT

A dryer having a waste heat recovery device includes a cabinet, a drum rotatably mounted within the cabinet and having a front surface and a rear surface, an intake duct configured to provide an intake flow path through which air flows into the drum, an exhaust duct configured to exhaust air coming from the drum out of the cabinet, a heater configured to heat air flowing into the drum, and an ambient air duct configured to inhale air from outside the cabinet and supply the air from outside the cabinet into the drum. The waste heat recovery device includes an evaporation unit configured to absorb heat from air that is exhausted from the drum, a condenser unit configured to transfer heat absorbed from the evaporation unit to ambient air that flows into the ambient air duct, and a heat transfer medium configured to transfer heat between the evaporation unit and the condenser unit. The ambient air duct is configured to communicate air from the ambient air duct into the intake duct at a point along a flow path between the drum and the heater.

18 Claims, 8 Drawing Sheets

(51) Int. Cl.
*D06F 58/02* (2006.01)
*F28D 15/02* (2006.01)

(56) References Cited

U.S. PATENT DOCUMENTS 4,688,336 A * 8/1987 Egger ..... F26B 11/187 34/109
6,904,703 B2 * 6/2005 Naganawa ..... D06F 43/086 34/596
7,322,123 B2 * 1/2008 Tadano ..... D06F 58/206 34/77
7,908,766 B2 * 3/2011 Ahn ..... D06F 58/206 126/21 A
7,980,002 B2 * 7/2011 Eichler ..... F26B 11/026 118/19
8,567,090 B2 * 10/2013 Bringewatt ..... D06F 39/006 165/104.21
9,080,280 B2 * 7/2015 Koops ..... D06F 58/02
2005/0086832 A1 * 4/2005 Declos ..... F26B 21/004 34/604
2008/0113609 A1 * 5/2008 Ehlers ..... D06F 58/20 454/241
2009/0211107 A1 * 8/2009 Laube ..... D06F 58/02 34/218
2011/0302802 A1 12/2011 Wiseman et al.
2012/0017464 A1 1/2012 Beers et al.
2014/0165420 A1 6/2014 Hoefler et al.
2014/0373379 A1 * 12/2014 Kim ..... D06F 58/206 34/86

FOREIGN PATENT DOCUMENTS

CN 101680155 3/2010
DE EP 2055826 A1 * 5/2009 ..... D06F 58/206
DE 102011078922 A1 1/2013
KR 20140147601 A * 12/2014 ..... D06F 58/206
KR EP 2816152 A1 * 12/2014 ..... D06F 58/206

OTHER PUBLICATIONS

Office Action issued in Chinese Application No. 201410280864.3 on Dec. 3, 2015, 10 pages.

* cited by examiner

DRYER WITH A WASTE HEAT RECOVERY MEANS

CROSS-REFERENCE TO RELATED APPLICATION

Pursuant to 35 U.S.C. §119(a), this application claims the benefit of earlier filing date and right of priority to Korean Application No. 10-2013-0071177, filed on Jun. 20, 2013, the contents of which are incorporated by reference herein in their entirety.

TECHNICAL FIELD

The present application relates to a dryer with a waste heat recovery device, and more particularly, to a dryer having a device for recovering and reusing heat energy contained in air exhausted from the dryer.

BACKGROUND

In general, a laundry treating apparatus having a drying function such as a washer or dryer is a device for putting the laundry in a state that washing is completed and the dehydration process is finished into the drum, and supplying hot air into the drum to evaporate the moisture of the laundry and dry the laundry.

For example, a dryer may include a drum rotatably provided within the body to put the laundry thereinto, a drive motor configured to drive the drum, a blower fan configured to blow air into the drum, and a heating device configured to heat the air flowing into the drum. Furthermore, the heating device may use electrical resistance heat at high temperature generated using an electrical resistance or the heat of combustion generated by burning gas.

Air coming out of the drum may contain the moisture of the laundry within the drum, thus becoming air under a medium temperature and humidity condition. Here, a dryer can be classified according to a method of treating the medium temperature and humid air, and can be divided into 1) a condensation type (circulation type) dryer for cooling air below its dew-point temperature through the condenser while circulating the medium temperature and humid air without being exhausted to the outside to condensate moisture contained in the medium temperature and humid air, and 2) an exhaustion type dryer for allowing the medium temperature and humid air to be directly exhausted and wasted to the outside.

In case of the condensation type dryer, in order to condensate air exhausted from the drum, the air should be subject to the process of cooling below the dew-point temperature and heated through the heating device prior to being supplied to the drum. Here, a loss of heat energy contained in the air may be generated while being cooled during the condensation process, and an additional heater or the like may be needed to heat the air to a temperature required for drying.

In case of the exhaustion type dryer, it may be required to exhaust the medium temperature and humid air to the outside and inhale ambient air to heat the air to a temperature level required for drying through a heating device. In particular, high temperature air being exhausted to the outside contains heat energy transferred by the heating device; because the air is exhausted and wasted to the outside, heat efficiency be reduced.

Accordingly, in recent years, laundry treating apparatuses for collecting energy required to generate hot air and energy being exhausted to the outside without being used have been introduced to increase energy efficiency, and a laundry treating apparatus having a heat pump system has been introduced as an example of such laundry treating apparatus. The heat pump system may include two heat exchangers, a compressor and an expansion apparatus, and energy contained in the exhausted hot air is recovered and reused in heating up air being supplied to the drum, thereby increasing energy efficiency.

Specifically, in the heat pump system, an evaporator is provided at the exhaust side, and a condenser at an inlet side of the drum, and thus thermal energy is transferred to refrigerant through the evaporator and then thermal energy contained in the refrigerant is transferred to air flowing into the drum through the condenser, thereby generating hot air using waste energy. Here, a heater for reheating air that has been heated up while passing through the evaporator may be additionally provided therein.

However, the heat pump system should be additionally provided with a compressor, an expansion apparatus, and the like in addition to the two heat exchangers. As an alternative of the heat pump system, there exists also an example of using a heat pipe. The heat pipe can transfer heat from the high temperature side to the low temperature side while sealed refrigerant repeats evaporation and condensation with no additional power source.

SUMMARY

Accordingly, an object of the present application is to provide a dryer having a waste heat recovery device capable of minimizing changes in drying performance even when used for a long period of time.

According to one aspect, a dryer having a waste heat recovery device includes a cabinet, a drum rotatably mounted within the cabinet and having a front surface and a rear surface, an intake duct configured to provide an intake flow path through which air flows into the drum, an exhaust duct configured to exhaust air coming from the drum out of the cabinet, a heater configured to heat air flowing into the drum, and an ambient air duct configured to inhale air from outside the cabinet and supply the air from outside the cabinet into the drum. The waste heat recovery device includes an evaporation unit configured to absorb heat from air that is exhausted from the drum, a condenser unit configured to transfer heat absorbed from the evaporation unit to ambient air that flows into the ambient air duct, and a heat transfer medium configured to transfer heat between the evaporation unit and the condenser unit. The ambient air duct is configured to communicate air from the ambient air duct into the intake duct at a point along a flow path between the drum and the heater.

Implementations of this aspect may include one or more of the following features. For example, the waste heat recovery device may be disposed at a rear side of the drum. The waste heat recovery device may include one or more pulsating heat pipes (PHPs) and a casing in which the one or more PHPs is fixed, wherein the heat transfer medium may be sealed within each of the one or more PHPs. The intake duct may include a back duct located on the rear surface of the drum, and the ambient air duct may be disposed between the casing and the back duct. The casing may define an ambient air inlet port through which ambient air enters the casing, and the casing may be configured to guide ambient air that has passed through the ambient air inlet port into the ambient air duct. The back duct and the ambient air duct may define communication ports disposed to face each other, respectively, and the communication ports may be disposed at a location that is vertically lower than that of the ambient air inlet port. A plurality of the PHPs may extend along a flow direction of air being exhausted. Positions of the plurality of the PHPs may be staggered relative to each other. At least one of the one or more PHPs may include a plurality of fins on a portion corresponding to the condenser unit of the at least one PHP. The plurality of fins may not be included on at least a part of a portion corresponding to the evaporation unit of the one or more PHPs.

According to another aspect, a dryer having a waste heat recovery device includes a cabinet, a drum rotatably mounted within the cabinet and having a front surface and a rear surface, an exhaust duct configured to exhaust air coming from the drum out of the cabinet, a gas heater configured to heat air flowing into the drum, a funnel configured to collect heated air generated by the gas heater, a back duct configured to supply the heated air discharged from the funnel to the drum, the back duct being located on the rear surface of the drum, and an ambient air duct configured to inhale air from outside the cabinet and supply the air from outside the cabinet into the drum. The waste heat recovery device includes an evaporation unit configured to absorb heat from air that is exhausted from the drum, a condenser unit configured to transfer heat absorbed from the evaporation unit to ambient air that flows into the ambient air duct, and a heat transfer medium configured to transfer heat between the evaporation unit and the condenser unit. The ambient air duct is configured to communicate air from the ambient air duct into the back duct.

Implementations of this aspect may include one or more of the following features. For example, the waste heat recovery device may include one or more pulsating heat pipes (PHPs) and a casing in which the one or more PHPs is fixed, wherein the heat transfer medium may be sealed within each of the one or more PHPs. The casing may define an ambient air inlet port through which ambient air enters the casing, and the casing may be configured to guide ambient air that has passed through the ambient air inlet port into the ambient air duct. The ambient air inlet port may be located at an upper portion of the casing at position that is vertically higher than a position at which air is communicated from the ambient air duct into the back duct. The back duct may define a funnel insertion port into which an end portion of the funnel is inserted, and an inner diameter of the funnel insertion port may be greater than an outer diameter of the funnel. The back duct may define a funnel insertion port into which an end portion of the funnel is inserted, and an inner circumferential surface of the funnel insertion port may be configured to make contact with an outer circumferential surface of the funnel.

According to yet another aspect, a dryer includes a cabinet, a drum rotatably mounted within the cabinet, a first heater configured to generate hot air; a blower that allows the hot air generated by the first heater to be inhaled into the drum and the hot air from the drum to be exhausted, and a second heater configured to heat ambient air using heat energy from the hot air being exhausted by the blower. The ambient air heated by the second heater is mixed with hot air downstream of the first heater before being supplied to the drum.

Implementations of this aspect may include one or more of the following features. For example, the ambient air may be inhaled through an additional flow path that is separate from a flow path for the hot air before being mixed with the hot air. The blower may include a blower fan. The second heater may include a waste heat recovery means.

The details of one or more implementations described in this specification are set forth in the accompanying drawings and the description below. Other potential features and aspects of the present application will become apparent from the descriptions, the drawings and the claims.

BRIEF DESCRIPTION OF THE DRAWINGS

Like reference symbols in the various drawings indicate like elements.

DETAILED DESCRIPTION

Figure 1:
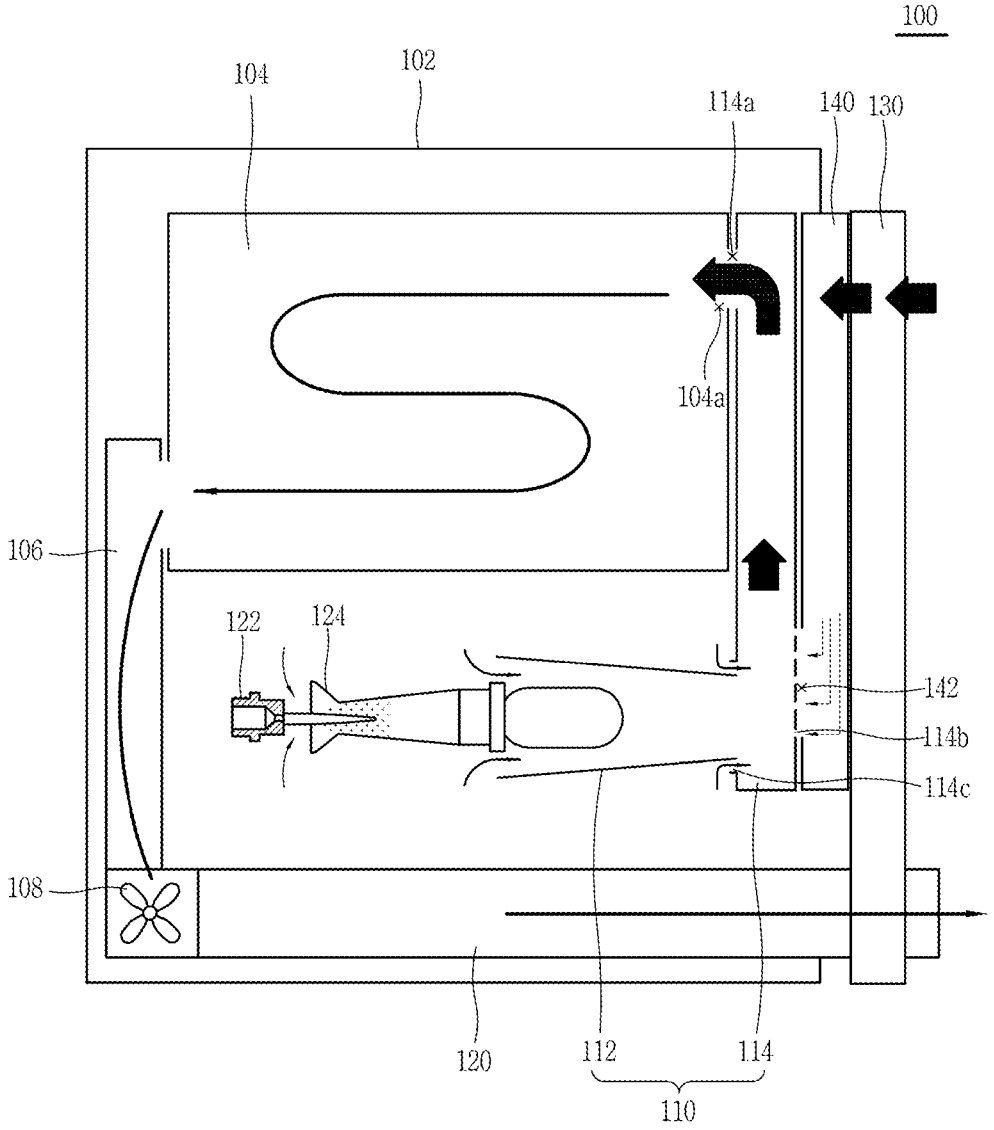
FIG. 1 is a schematic view of an example dryer having a waste heat recovery device.
Figure 2:
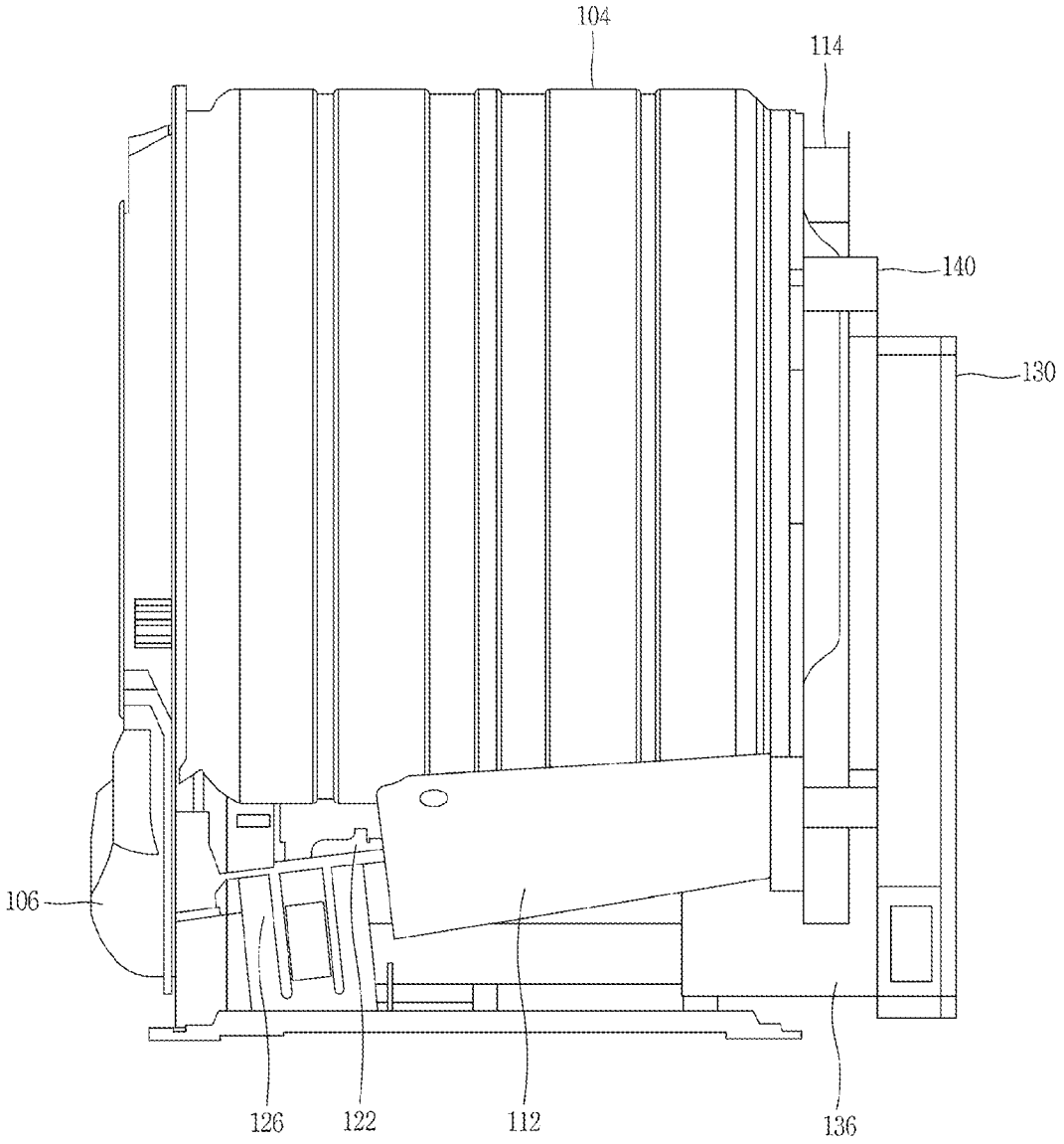
FIG. 2 is a side view illustrating an internal structure of the dryer of FIG. 1.
Figure 3:
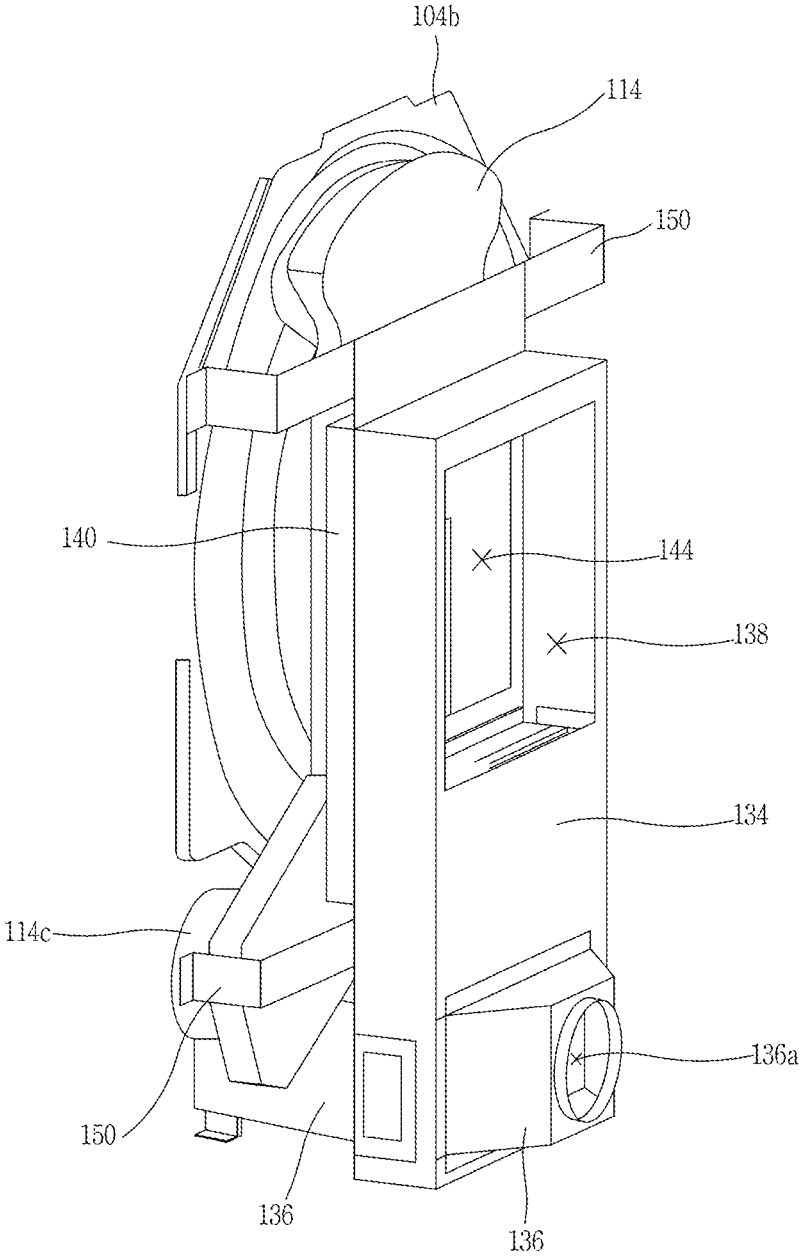
FIG. 3 is a perspective view illustrating a rear surface side of a drum in the dryer of FIG. 1.

FIG. 1 illustrates a dryer having a waste heat recovery device according to a first implementation of the present disclosure, and FIG. 2 illustrates an internal structure of the first implementation. FIG. 3 illustrates a rear surface side of a drum in the first implementation. Referring to FIGS. 1 through 3, the first implementation of a dryer 100 may include a cabinet 102 having a substantially rectangular parallelepiped shape, and a drum 104 for putting the laundry which is a drying object thereinto is rotatably mounted within the cabinet 102.

An air supply opening 104*a* is configured to supply hot air for drying the laundry, and the supplied hot air is passed through an inner portion of the drum and exhausted to a lint filter installation unit 106 connected to a lower end of the front surface portion. A lint filter for collecting foreign substances such as lint or the like separated from the laundry is mounted within the lint filter installation unit 106 and can be formed with a flow path (or a passage) for moving the exhausted hot air.

Here, a funnel 112 for collecting hot air generated by a gas heater, which will be described later, is provided at a lower portion of the drum 104, and an end portion of the funnel 112 is connected to a back duct 114.

The back duct 114 is located on a rear surface of the drum 104, and performs the role of transferring hot air discharged from the funnel 112 to the air supply opening 104*a* of the drum 104. The funnel 112 and the back duct 114 function as an intake duct 110 for guiding the air existing within the cabinet into the drum. Furthermore, a funnel insertion port 114*c* into which an end portion of the funnel is inserted is formed on the back duct 114. An inner diameter of the funnel insertion port 114*c* is greater than an outer diameter of the funnel 112, and therefore, it is configured such that air within the cabinet can be inhaled into the back duct 114 through a gap between an outer circumferential portion of the funnel 112 and an inner circumferential portion of the funnel insertion port 114*c*.

Here, the intake duct 110 may include the funnel 112 and the back duct 114, but may not be necessarily limited to this configuration. For example, the funnel 112 and the back duct 114 may be integrally formed, or a separate duct may be additionally provided within the intake duct 110. An exhaust portion 114*a* of the back duct 114 is disposed to face the air supply opening 104*a*.

A blower fan 108 for causing the flow of air is provided at the exhaust side of the lint filter installation unit 106, and an exhaust duct 120 for discharging air exhausted from the drum to an outside of the cabinet 102 is provided at a rear side of the blower fan 108.

Furthermore, a gas heater is located on a front surface of the funnel 112. The gas heater may include a gas nozzle 122 for spraying gas and a mixing pipe 124 for mixing gas sprayed from the gas nozzle and air. Referring to FIG. 2, a supporting bracket 126 for supporting the gas nozzle and mixing pipe can be provided on a bottom surface of the cabinet.

When gas supplied through a gas pipe is sprayed through the gas nozzle and ignition is made, flame is generated from the mixing pipe 124 into the funnel 112. As a result, air within the cabinet inhaled through the funnel 112 is heated by the flame and inhaled into the drum through the back duct 114.

On the other hand, air exhausted through the exhaust duct 120 contains higher temperature and humidity compared to the air around the cabinet, and thus has more heat energy. A waste heat recovery device 130 for collecting heat energy is located on a rear surface of the drum. Here, the waste heat recovery device 130 may be located out of the cabinet as illustrated in the drawing, or may be disposed within the cabinet.

The waste heat recovery device 130 inhales and heats ambient air and then supplies the air to the back duct 114. Thus, the ambient air is heated while passing through the waste heat recovery device 130, and moves along an ambient air duct 140 disposed between the back duct 114 and the waste heat recovery device 130. The ambient air duct 140 is formed such that ambient air is inhaled through the surrounding area of an upper end portion thereof and moves toward a lower side thereof. In some cases, the waste heat recovery device can be a heater.

The ambient air duct 140 is communicated with the intake duct 110 between the drum 104 and heater. For example, the ambient air duct 140 is communicated with the back duct 114.

An ambient air outlet port 142 is disposed at a lower end portion of the ambient air duct 140 and faces an ambient air inlet port 114*b* formed at the back duct 114. Accordingly, the heated ambient air is inhaled into the back duct 114 through the ambient air outlet port 142 and then mixed with hot air discharged from the funnel 112 before being supplied to the drum 104.

In some cases, the waste heat recovery device 130 may include a pulsating heat pipe (PHP) 132 (refer to FIG. 4) and a casing 134 within which the PHP 132 can be accommodated. The casing 134 can have an extended rectangular parallelepiped shape, and can be positioned within the cabinet by a fixed bracket 150 (refer to FIG. 3). An expansion pipe portion 136 having a substantially rectangular shaped cross-section for communicating with the exhaust duct 120 is disposed at a lower portion of the casing 134. The expansion pipe portion 136 has a larger cross-sectional area compared to that of the exhaust duct 120. With this structure, air exhausted from the exhaust duct 120 can be brought into contact with the PHP 132 over a larger area, than if the air contacted the PHP 132 directly from the exhaust duct 120. An exhaust port 136*a* can be provided on one lateral surface of the expansion pipe portion 136, and air is exhausted to an outside of the cabinet through the exhaust port 136*a*.

An ambient air inhalation port 138 for inhaling ambient air is formed at an upper portion of the casing 134. The ambient air inhalation port 138 has an area capable of exposing all the condenser unit of the PHP 132 which will be described later, and aligned with respect to an ambient air inlet port 144 provided in the ambient air duct 140. Accordingly, ambient air is inhaled to the ambient air duct 140 through the ambient air inhalation port 138 and the ambient air inlet port 144, and heated while being brought into contact with the PHP 132 during the process.

The back duct 114 and the ambient air duct 140 comprise communication ports 114*b*, 142 disposed to face each other, respectively, and the communication ports are disposed at a location lower than that of the ambient air inlet inhalation port 138.

The back duct 114 can be mounted on a rear supporter 104*b* that supports a rear surface of the drum 104, and an upper end portion thereof can have a fan shape to minimize flow resistance applied to hot air flowing into the drum 104. Furthermore, the back duct 114, the ambient air duct 140, and casing 134 are fixed in a state where they are brought into contact with each other. As a result, heat energy transferred from the back duct 114 can be transferred to ambient air passing through the ambient air duct 140, thereby minimizing thermal loss from the back duct 114.

Figure 4:
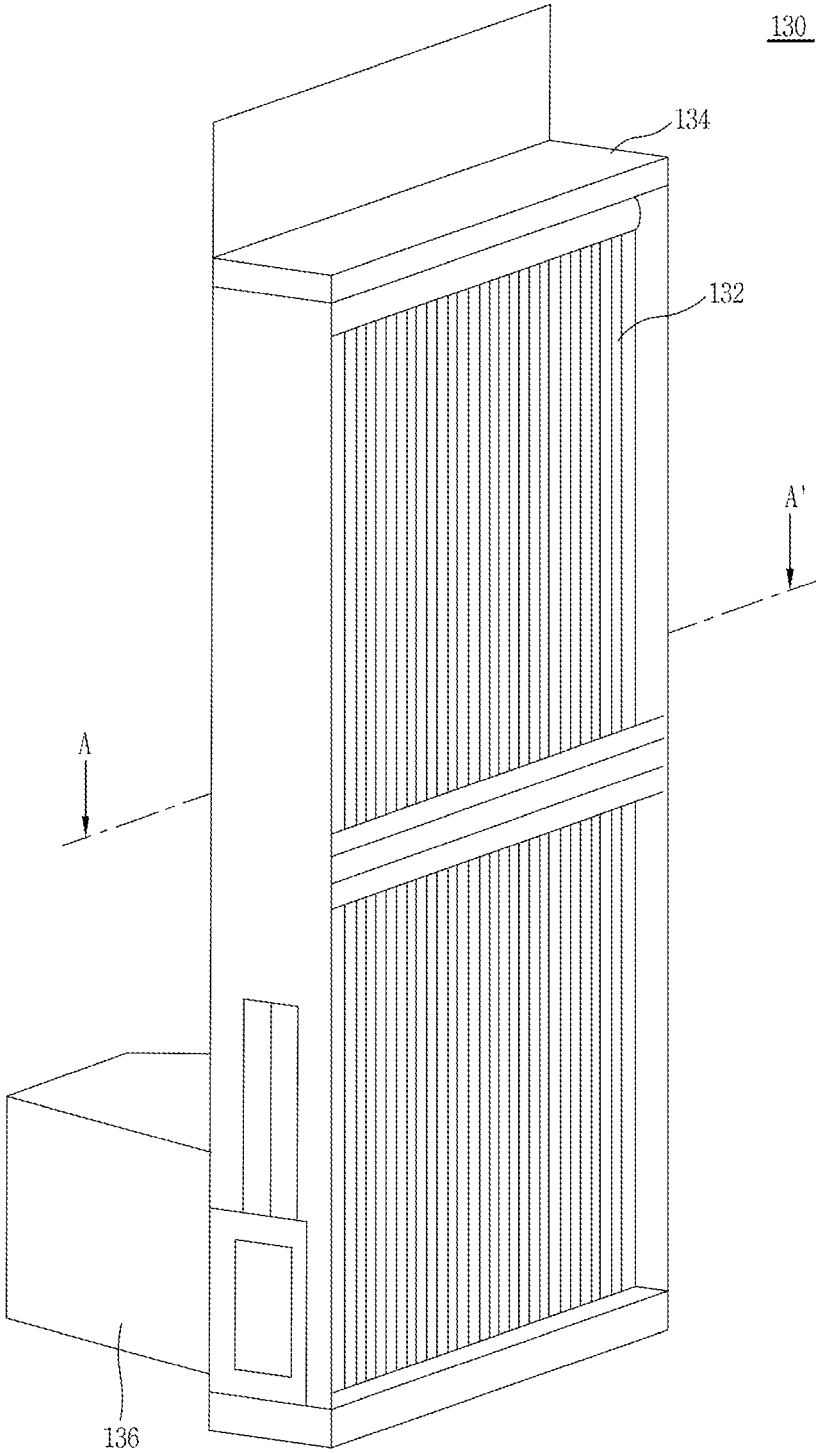
FIG. 4 is a perspective view illustrating a waste heat recovery device provided in the dryer of FIG. 1.
Figure 5:
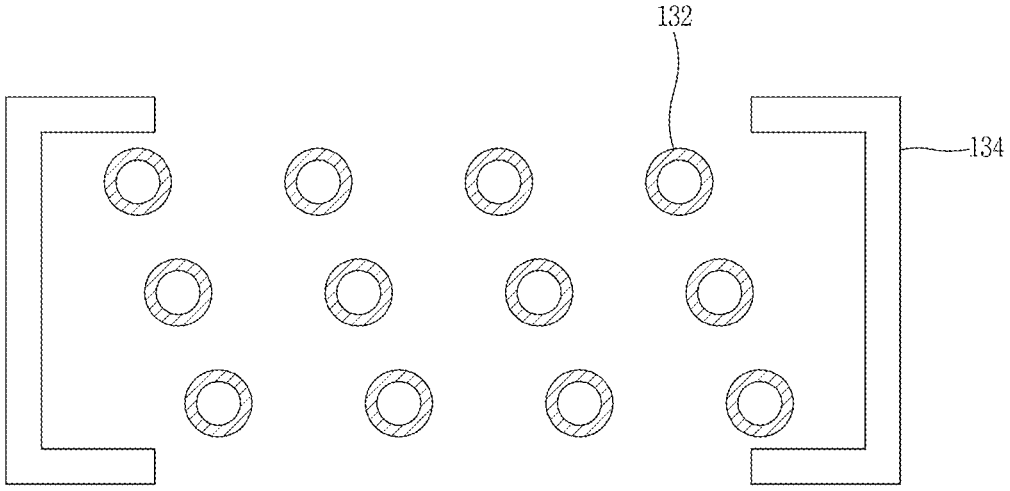
FIG. 5 is a cross-sectional view along line A-A' in FIG. 4.

Referring to FIG. 4, a plurality of the PHPs 132 are disposed according to the flow direction of air being exhausted. For example, the plurality of PHPs 132 are disposed within the casing 134 to be extended in a vertical direction. The PHP 132 generally has a tube shape, and a heat transfer medium is sealed therein. The plurality of PHPs 132 can be disposed to form total three columns as illustrated in FIG. 5. Of course, the configuration of PHPs 132 may not be necessarily limited to three columns, and may be also disposed to form one or any number of columns.

As illustrated in FIG. 5, positions of the PHPs 132 may be staggered relative to each other to maximize the amount of exhausted hot air or inhaled ambient air that is brought into contact with the PHPs 132.

Figure 6:
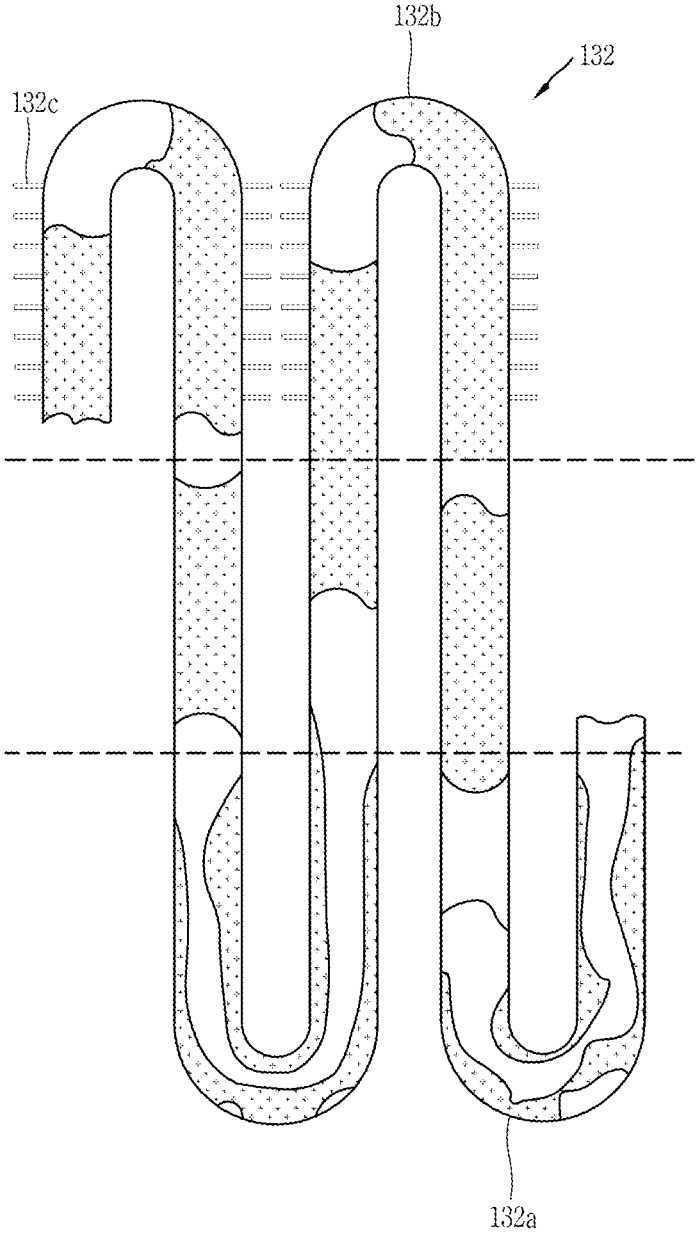
FIG. 6 is an enlarged cross-sectional view illustrating a pulsating heat pipe (PHP) provided in the dryer of FIG. 1.

Referring to FIG. 6, the PHP 132 may include an evaporation unit 132*a* located within the expansion pipe portion 136 and a condenser unit 132*b* exposed through the ambient air inhalation port 138. The evaporation unit 132*a* absorbs heat energy contained in the exhausted air to evaporate the heat transfer medium sealed therein. The evaporated heat transfer medium rises up and moves to the condenser unit 132*b*, where the heat transfer medium condenses while transferring heat to ambient air and moves again to the evaporation unit 132*a*. Here, in order to enhance heat transfer efficiency, a plurality of fins 132*c* may be formed on a portion of the PHP 132 corresponding to the condenser unit 132*b*. In some cases, such fins may not be formed on a portion of the PHP 132 corresponding to the evaporation unit 132*a*.

A small amount of lint or foreign substances may be contained in the exhausted air, and thus when fins are formed on portions corresponding to the evaporation unit 132*a*, the lint or the like may be caught in the fins to obstruct the flow of air and heat transfer. However, in some cases, the fins may be also formed on portions corresponding to the evaporation unit 132*a* by establishing the spacing between such fins to be greater than those of fins that are on portions corresponding to the condenser unit 132*b*.

Therefore, at least some of the PHPs 132 is formed with the plurality of fins 132*c* for expanding their surface area on a portion corresponding to the condenser unit 132*b*. The fins 132*c* may be not formed on at least part of a portion corresponding to the evaporator of the PHPs 132.

The PHP transports latent heat contained in working fluid due to the vibration of working fluid generated between the evaporation unit and condenser unit to transfer heat. Accordingly, there is no wick for flowing liquid that has been condensed in the condenser unit back to the evaporation unit, thereby resulting in a simple structure and allowing various types of fabrication. Here, the PHP may have a tube shape as illustrated in the drawing and, in some cases, can have an internally partitioned flat tube shape.

Hereinafter, an exemplary operation of the first implementation will be described.

During the drying process, air is moved along the intake duct and exhaust duct by a blower fan. The air within the cabinet that is inhaled into the intake duct, particularly the funnel, is heated by the gas heater to temperatures of about 700-800° C. The hot air is inhaled into the back duct, mixed with air within the cabinet inhaled through a gap between the funnel insertion port and the funnel, and cooled to be within a predetermined temperature range. At the same time, ambient air is also inhaled into the waste heat recovery device by the blower fan. The inhaled ambient air is heated while passing through the condenser unit, after which it moves along the ambient air duct and is subsequently supplied to the back duct.

Accordingly, the hot and ambient air are mixed within the back duct, and as a result, hot air having a temperature of approximately 250° C. is supplied into the drum. When a gas heater is used, air at normal temperature should be mixed with the hot air to cool the air to a suitable temperature since the temperature of the hot air is high as described above. According to the foregoing implementation, the air being supplied for cooling has a temperature higher than the normal temperature, thereby reducing the amount of gas supplied to the gas heater.

Furthermore, the supplied ambient air is supplied through an additional flow path (or an additional passage) separated from the intake duct before being mixed. Therefore, the intake duct is not affected even when foreign substances have accumulated in the condenser unit; as such, the dryer is able to constantly maintain the drying performance even if used for a long period of time.

Figure 7:
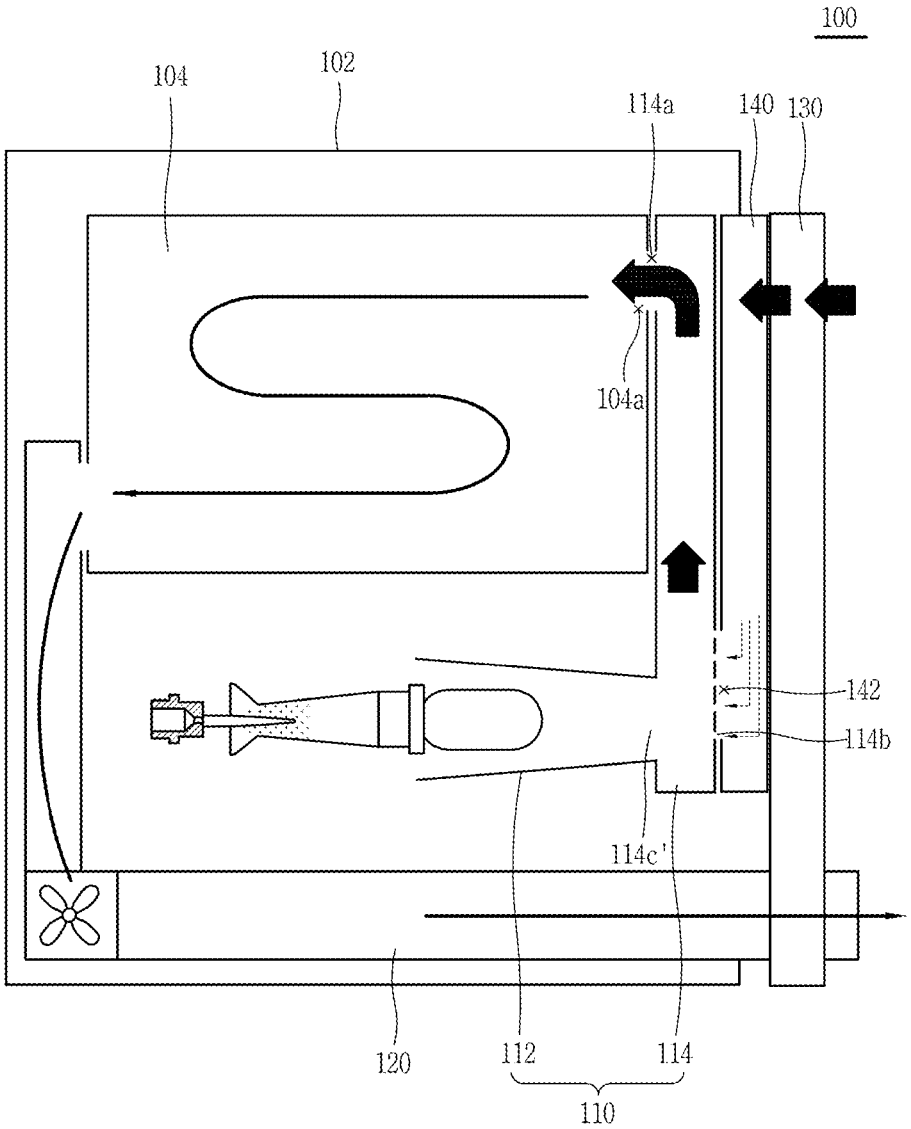
FIG. 7 is a schematic view of another example dryer having a waste heat recovery device.

According to the first implementation, the funnel insertion port and an outer circumferential portion of the funnel are separated from each other. However, in another implementation, an inner circumferential surface of the funnel insertion port 114*c*' may be brought into contact with an outer circumferential surface of the funnel as illustrated in FIG. 7. In this case, the cooling of the hot air is entirely carried out by ambient air, thereby further reducing the amount of used gas.

Figure 8:
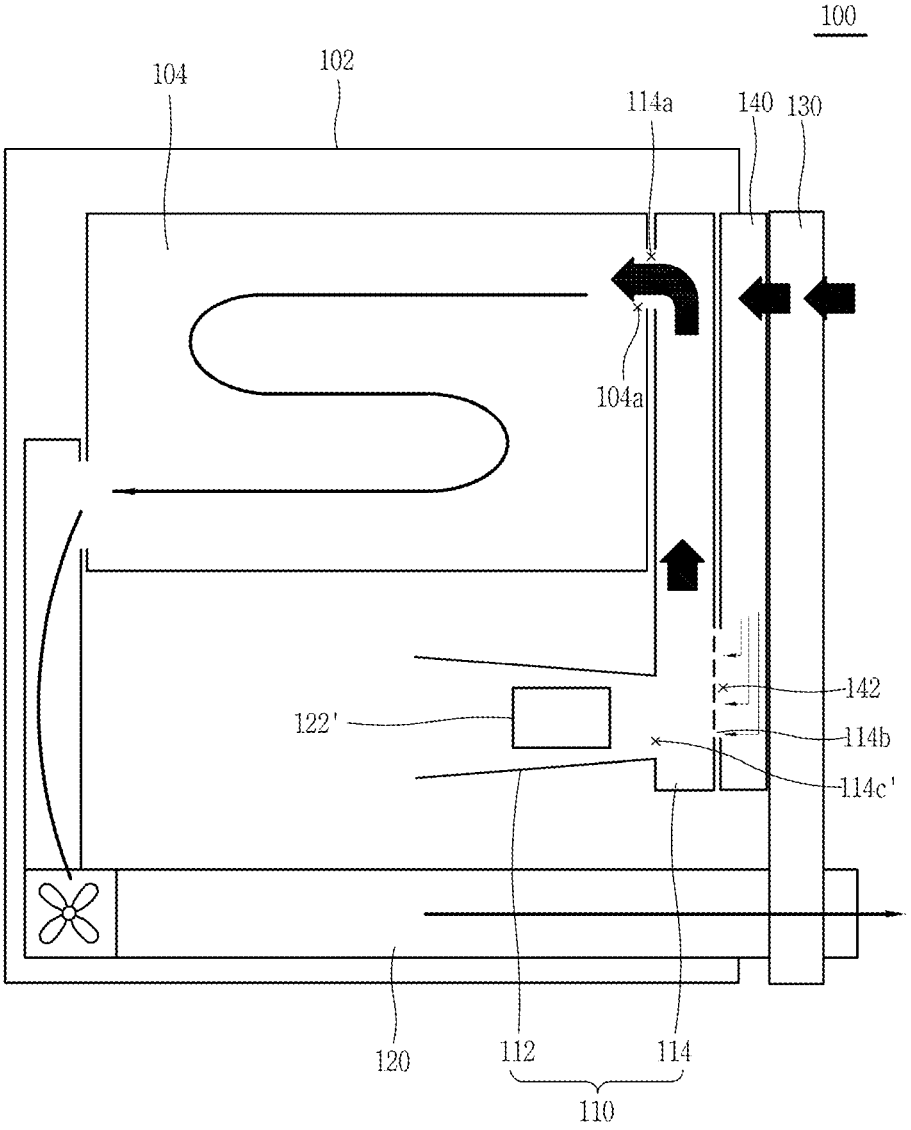
FIG. 8 is a schematic view of yet another example dryer having a waste heat recovery device.

Furthermore, the present disclosure may not be necessarily limited to a case where the gas heater is used, and may be also applicable to a case where an electric heater is used. For example, as illustrated in FIG. 8, an electric heater 122' may be provided in the intake duct instead of the gas heater. Here, in case of an electric heater, the temperature of the generated hot air can be freely adjusted, and thus the cooling of hot air as in the gas heater may not be required. Accordingly, as illustrated in the implementation shown in FIG. 7, an inner circumferential surface of the funnel insertion port 114*c*' can be brought into contact with an outer circumferential surface of the funnel.

Here, ambient air heated by a waste heat recovery device has a temperature lower than that of the electric heater and thus the temperature of hot air mixed in the back duct is lower than that of hot air immediately subsequent to passing through the electric heater. Accordingly, the temperature of hot air that has passed through the electric heater is set to be higher than 250° C., which is a temperature of hot air supplied to the drum.

When an electric heater is used, a heat pump may be provided at the same time. In other words, a condenser of the heat pump may be provided at a front end of the intake duct to heat air in advance and then selectively heat the air using the electric heater. In this case, the heated ambient air may flow between the condenser and the electric heater or flow to a downstream side of the heater.

It will be apparent to those skilled in the art that this application is not intended to be limited to the above-described implementations and drawings, and various changes or modifications may be made therein without departing from the scope and the technical sprit of this application.

What is claimed is:

1. A dryer having a waste heat recovery device, the dryer comprising:
- a cabinet;
- a drum rotatably mounted within the cabinet and having a front surface and a rear surface;
- an intake duct configured to provide an intake flow path through which air flows into the drum;
- an exhaust duct configured to exhaust air coming from the drum out of the cabinet;
- a heater configured to heat air flowing into the drum;
- an ambient air duct configured to inhale air from outside the cabinet and supply the air from outside the cabinet into the drum; and
- the waste heat recovery device comprising:
  - an evaporation unit configured to absorb heat from air that is exhausted from the drum,
  - a condenser unit configured to transfer heat absorbed from the evaporation unit to ambient air that flows into the ambient air duct,
  - a heat transfer medium configured to transfer heat between the evaporation unit and the condenser unit,
  - one or more pulsating heat pipes (PHPs), and
  - a casing in which the one or more PHPs is fixed,
- wherein the ambient air duct is configured to communicate air from the ambient air duct into the intake duct at a point along a flow path between the drum and the heater, and
- wherein the heat transfer medium is sealed within each of the one or more PHPs.

2. The dryer of claim 1, wherein the waste heat recovery device is disposed at a rear side of the drum.

3. The dryer of claim 1, wherein the intake duct comprises a back duct located on the rear surface of the drum, and wherein the ambient air duct is disposed between the casing and the back duct.

4. The dryer of claim 3, wherein the casing defines an ambient air inlet port through which ambient air enters the casing, the casing being configured to guide ambient air that has passed through the ambient air inlet port into the ambient air duct.

5. The dryer of claim 4, wherein the back duct and the ambient air duct define communication ports disposed to face each other, respectively, and the communication ports are disposed at a location that is vertically lower than that of the ambient air inlet port.

6. The dryer of claim 1, wherein a plurality of the PHPs extend along a flow direction of air being exhausted.

7. The dryer of claim 6, wherein positions of the plurality of the PHPs are staggered relative to each other.

8. The dryer of claim 1, wherein at least one of the one or more PHPs includes a plurality of fins on a portion corresponding to the condenser unit of the at least one PHP.

9. The dryer of claim 8, wherein the plurality of fins is not included on at least a part of a portion corresponding to the evaporation unit of the one or more PHPs.

10. A dryer having a waste heat recovery device, the dryer comprising:

a cabinet;

a drum rotatably mounted within the cabinet and having a front surface and a rear surface;

an exhaust duct configured to exhaust air coming from the drum out of the cabinet;

a gas heater configured to heat air flowing into the drum;

a funnel configured to collect heated air generated by the gas heater;

a back duct configured to supply the heated air discharged from the funnel to the drum, the back duct being located on the rear surface of the drum;

an ambient air duct configured to inhale air from outside the cabinet and supply the air from outside the cabinet into the drum; and the waste heat recovery device comprising:

an evaporation unit configured to absorb heat from air that is exhausted from the drum, a condenser unit configured to transfer heat absorbed from the evaporation unit to ambient air that flows into the ambient air duct, a heat transfer medium configured to transfer heat between the evaporation unit and the condenser unit, one or more pulsating heat pipes (PHPs), and casing in which the one or more PHPs is fixed, wherein the ambient air duct is configured to communicate air from the ambient air duct into the back duct, wherein the heat transfer medium is sealed within each of the one or more PHPs.

11. The dryer of claim 10, wherein the casing defines an ambient air inlet port through which ambient air enters the casing, the casing being configured to guide ambient air that has passed through the ambient air inlet port into the ambient air duct.

12. The dryer of claim 11, wherein the ambient air inlet port is located at an upper portion of the casing at position that is vertically higher than a position at which air is communicated from the ambient air duct into the back duct.

13. The dryer of claim 10, wherein the back duct defines a funnel insertion port into which an end portion of the funnel is inserted, an inner diameter of the funnel insertion port being greater than an outer diameter of the funnel.

14. The dryer of claim 10, wherein the back duct defines a funnel insertion port into which an end portion of the funnel is inserted, an inner circumferential surface of the funnel insertion port being configured to make contact with an outer circumferential surface of the funnel.

15. A dryer comprising:

a cabinet;

a drum rotatably mounted within the cabinet;

a first heater configured to generate hot air;

a blower that allows the hot air generated by the first heater to be inhaled into the drum and the hot air from the drum to be exhausted; and a second heater configured to heat ambient air using heat energy from the hot air being exhausted by the blower, wherein the ambient air heated by the second heater is mixed with the hot air generated by the first heater so as to cool the hot air generated by the first heater before being supplied to the drum.

16. The dryer of claim 15, wherein the ambient air is inhaled through an additional flow path that is separate from a flow path for the hot air before being mixed with the hot air.

17. The dryer of claim 15, wherein the blower comprises a blower fan.

18. The dryer of claim 15, wherein the second heater comprises a waste heat recovery means.

* * * * *